United States Patent [19]

Rupp et al.

[11] · Patent Number: 4,492,154

[45] Date of Patent: Jan. 8, 1985

[54] OVERLOAD PROTECTION IN PRESSES

[75] Inventors: Werner Rupp, Heiningen; Johannes Koch, Weilheim, both of Fed. Rep. of Germany

[73] Assignee: L. Schuler GmbH, Goeppingen, Fed. Rep. of Germany

[21] Appl. No.: 572,305

[22] Filed: Jan. 20, 1984

[30] Foreign Application Priority Data

Jan. 22, 1983 [EP] European Pat. Off. ..... 83100561.6

[51] Int. Cl.[3] ..... B30B 1/32

[52] U.S. Cl. ..... 100/53; 100/269 R

[58] Field of Search ..... 100/43, 48, 53, 193, 100/207, 269 R; 83/639; 72/453.01, 453.02

[56] References Cited

FOREIGN PATENT DOCUMENTS 2828315 10/1980 Fed. Rep. of Germany .
1171320 11/1969 United Kingdom .
1340012 12/1973 United Kingdom .

*Primary Examiner*—Billy J. Wilhite
*Attorney, Agent, or Firm*—Craig & Burns

[57] ABSTRACT

An overload protection for presses in which the working stages are protected against overload by balance-like overload pressure-responsive devices; to further protect the press balance-like adding pressure-responsive devices are also used whose operating point adjusted to the limit loads of the connecting rods is adjusted to a smaller value than the sum of all of the balance-like overload pressure-responsive devices; the adding pressure-responsive devices are connected in parallel since the pressure space of each balance-like overload pressure-responsive device is connected to one pressure space each of each adding pressure-responsive device; the cross sectional areas of the pistons of the balance-like adding pressure-responsive devices are calculated from the distance of the working stages to the actuating planes; for the left adding pressure-responsive device, from the distance of the working stages to the right actuating plane whereas for the right adding pressure-responsive device, from the distance of the working stages to the left actuating plane. The pre-pressure in the pressure spaces is adjusted by way of pressure control devices supplied by pump aggregates.

4 Claims, 3 Drawing Figures

OVERLOAD PROTECTION IN PRESSES

The present invention relates to an overload protection in presses, such as multi-stage presses, transfer presses and the like, with rams driven by connecting rods in a first actuating plane and in a second actuating plane disposed remote thereto and acting on working stages, whereby at least one balance-like overload pressure-responsive device is coordinated to each working stage, which are connected in common to balance-like adding pressure devices and the value of the overall overload protection of each balance-like adding pressure-responsive device is adjusted smaller than the sum of the values of the individual overload protections of the balance-like overload pressure-responsive devices.

With presses of the aforementioned type having hydraulically operating overload protection measures in the individual working stages which act in common onto a balance-like adding pressure-responsive device of the ram, the given rated force of the ram to be safeguarded by the adding pressure-responsive device, is selected smaller than the sum of the maximum forces of the overload stages in order that the press need not be dimensioned unnecessarily strongly. In general, not all of the working stages are loaded at the same time with their maximum force. This lower limitation of the sum of the ram forces, however, does not preclude that the working stages located closer to an actuating plane are subjected to maximum loads and the remaining working stages are loaded only slightly and vice versa. This requires an unnecessarily strong dimensioning of the connecting rods, of the driving parts and of the supports or frame parts.

Protection measures in presses, stage-presses and the like are described in the German Auslegeschrift No. 12 46 652 with the use of a limit force device. As a rule the triggering of these means in case of an overload in the individual working stages or upon exceeding an overall overload leads to a cut-out or turning off of the press.

The German Pat. No. 1,288,431 and its corresponding British Pat. No. 1,171,320 describe a measure for the overall protection of a press or multi-stage-press in case of overload. The press drive thereby acts on different working stages which are each protected for itself by its own overload protection that turn off the press drive in case the limit load is exceeded in the working stage. Therebeyond, the overload protections of the individual working stages are connected to an overall overload protection which is thus acted upon continuously by all individual overload protections and whose turn off or cut-out value is adjusted to a value which is smaller than the sum of the overload values of the individual overload protections. This system permits a high loading of the driving or actuating planes and requires an excessive dimensioning of the structural driving parts.

The German Pat. No. 20 04 980 and its British counterpart No. 1,340,012 disclose an essentially similar installation for the overall overload protection of a press or multistage press with an overall overload protection each for the working stages of each driving or actuating point of the ram. In the calculations for the protective measures the distances of the individual working stages to the connecting rods are not taken into consideration in this patent and the installation therefore does not adequately protect the driving or actuating planes insofar as also the working stages located more remote from an actuating or driving plane which are not included in the associated overall overload protection, contribute components to the force in this plane according to the law of leverage.

In contrast thereto, it is the object of the present invention to protect the connecting rods as well as the driving parts and supports and frames of presses, especially of presses with press rams driven in two planes, also for asymmetrical load conditions of the press ram according to the limit load values of the connecting rods themselves and to detect and include thereby the force moments which occur as a consequence of the individual distances of the working stages to the connecting rods.

The underlying problems are solved according to the present invention in that a pressure space in a first balance-like adding pressure-responsive device and a pressure space in a second balance-like adding pressure-responsive device is coordinated to the pressure space of each balance-like overload pressure-responsive device, and in that the cross section of each piston acted upon in the first balance-like adding pressure-responsive device is proportional to the product of the distance of the connected working stage to the second driving or actuating plane and the piston cross section of the balance-like adding pressure-responsive device is proportional to the product of the distance of the connected working stage to the first driving or actuating plane and the piston cross section of the balance-like overload pressure-responsive device.

It is thereby of advantage that a small load occurring in a working stage remote from the connecting rod to which relates the cross section calculation of the pistons in the balance-like adding pressure-responsive device, is included when exceeding the limit load of the connecting rod and thus for the signal production respectively the turning-off of the press.

According to further features of the present invention the system also provides an overload protection of a press with an additional working stage or working stages located outside the area between the driving or actuating planes of but acted upon by the same ram also actuating other working stages, whereby an additional working stage may also be located essentially centrally in a driving plane of the ram.

In an advantageous manner the safety protection for the applications of the present invention may be calculated in such a manner that the limit value of the ram force is equal to the sum of the limit values of the connecting rod forces and an additional balance-like adding pressure-responsive device for the ram is thus not necessary.

These and other objects, features and advantages of the present invention will become more apparent from the following description when taken in connection with the accompanying drawing which shows, for purposes of illustration only, several embodiments in accordance with the present invention, and wherein.

Figure 1:
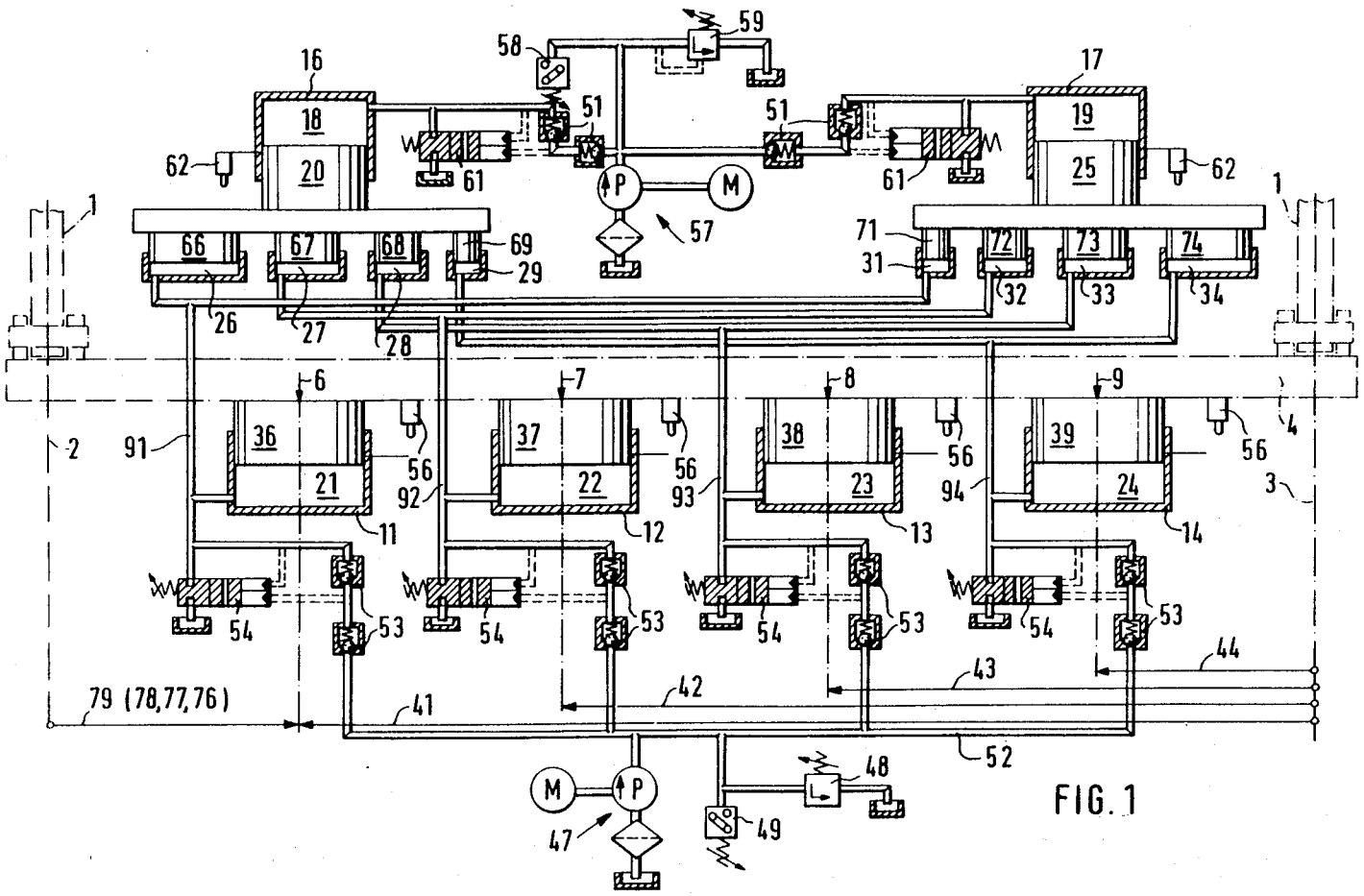
FIG. 1 is a schematic diagrammatic view of an overload protection for a press in accordance with the present invention.

Referring now to the drawing wherein like reference numerals are used throughout the various views to designate like parts, in the various figures the connecting rods 1 engage the ram 4 in the actuating planes 2 and 3. The working stages are designated by reference numerals 6, 7, 8 and 9 in FIG. 1 as well as for modified embodiments additionally by reference numeral 10 in FIG. 2 and by reference numeral 83 in FIG. 3. Balance-like overload pressure-responsive devices 11, 12, 13, 14 as well as 86 are interconnected in the force flow between each working stage and the ram 4. The balance-like overload pressure-responsive devices each include a pressure space 21, 22, 23, 24 and 84 as well as pistons 36, 37, 38, 39 and 85 which are operable to reciprocate therein, i.e., immerse into the pressure spaces when the ram 4 is driven by the connecting rods 1 to apply the intended press forces. The pressure spaces 21 to 24 and 84 are in fluid connection with pressure spaces 26, 27, 28 and 29 of a first balance-like adding pressure-responsive device 16 respectively 81 and with the pressure spaces 31, 32, 33 and 34 of a second balance-like adding pressure-responsive device 17 respectively 82. The pressure in the pressure spaces is pre-adjusted, and more particularly starting from the pump aggregate generally designated by reference numeral 47 by way of the pressure monitor 49 and the pressure limit regulator 48, the pressure feed line 52, check value 53 and pressure lines 91 to 94 coordinated to the individual systems. The pre-pressure in the pressure spaces is adjustable by conventional means. Three pressure spaces each are connected in parallel. Thus, for example the pressure space 21 of the left overload pressure-responsive device 11, the pressure space 26 of the adding pressure-responsive device 16 and the pressure space 31 of the adding pressure-responsive device 17 form a pressure system. The adding pressure-responsive devices 16 and 17 include each a pressure space 18 respectively 19, in which a pre-pressure is also adjusted that is produced by a pump aggregate generally designated by reference numeral 57 and is monitored respectively limited by the pressure monitor 58 and the pressure limit control 59. The pressure spaces are intentionally released by way of the pressure release or discharge lines 54 and 61, and more particularly always when the pressure in a balance-like overload pressure-responsive device or in a balance-like adding pressure-responsive device has exceeded a predetermined relationship to the pre-pressure. As a result thereof, the force flow in the corresponding working stages is immediately interrupted. The check valve 51 and 53 preclude a discharge or release of the remaining pressure spaces in case of a response of one of the individual overload pressure-responsive devices. Sensors 56, 62 are coordinated to each pressure-responsive device which turn-off or cut-out the press upon triggering of the corresponding balance-like pressure-responsive device.

Figure 3:
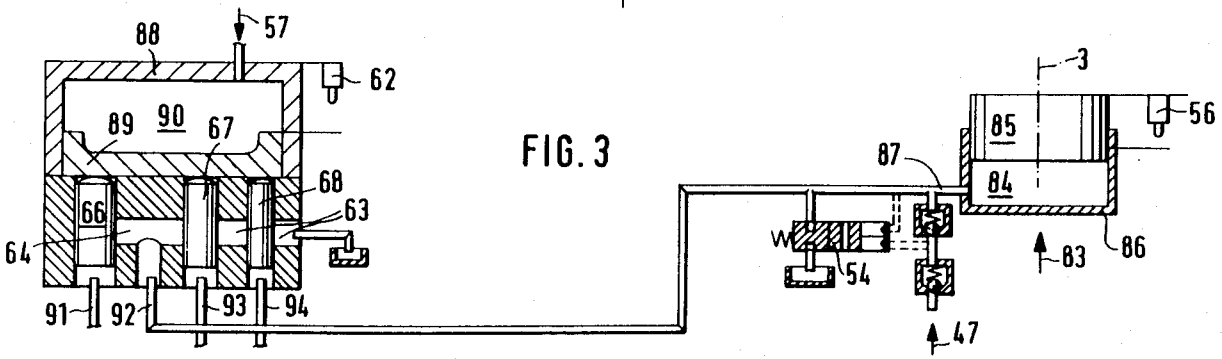
FIG. 3 is a partial schematic, diagrammatic view of a still further modified embodiment of an overload protection according to the present invention with a working stage arranged in an actuating plane.

The pressure lines 92, 93 and 94 also connect together the pressure spaces of pressure systems which belong together. The adding pressure-responsive devices 16 and 17 include, on the one hand, pistons 66 to 74 and 89 which are operable to immerse into the pressure spaces 26 to 29 and 31 to 34 and 90 and, on the other hand, pistons 20 and 25 in the pressure spaces 18 and 19. The pistons 66 to 74 have cross sections (diameters) of different magnitudes, which are proportional to and dependent on the distance of the respectively coordinated overload pressure-responsive device or the working stage to the actuating plane 2 respectively 3, multiplied by the piston cross section of the overload pressure-responsive device. The distances of the overload pressure-responsive devices (working stages) to the actuating plane 3 are designated by reference numerals 41 to 44; the corresponding distances of the overload pressure-responsive devices (working stages) to the actuating plane 2 are designated by reference numerals 79 to 76. With identical cross sectional area of the pistons 36, 37, 38, 39 and 85, the cross sectional areas of the pistons 66, 67, 68, 69 and 70 of the left balance-like adding pressure-responsive device 16 are proportional to the distance of the center of the respectively associated working stage to the driving or actuating plane 3. Thus, for the operating stage 6 located from the actuating plane 3 at the associated distance 41, a relatively large piston area of the piston 66 results therefrom which is deduced from this distance 41; for the operating stage 9 with the associated distance 44 a smaller cross sectional area of the piston 69 which is small in proportion to the distance 41. The calculation of the piston cross sections of the pistons 71 to 74 of the balance-like adding pressure-responsive device 17 takes place in an analogous manner. They are proportional to the distance of the associated working stage from the actuating plane 2. The force to be absorbed by each connecting rod is obtained from the support calculation for two supports and in this case for four forces spaced with respect to the actuating or driving planes. Each of these forces may lead to a cut-out of the press by way of the sensor 56 without exceeding the limit value of a connecting rod in the coordinated adding pressure-responsive device. In contrast thereto, each adding pressure-responsive device turns off the press if the limit value of a connecting rod is exceeded without the need that one of the individual overload pressure-responsive devices had been loaded in a manner that would trigger or switch the same, i.e. when the sum of the individual overload pressure-responsive devices exceeds the limit value. The pistons 66 to 69 of the adding pressure-responsive device 16 may thereby release or open up a line, as illustrated in FIG. 3, through which the pressure spaces of all working stages 21 to 24 and 84 become pressure-less at the same time. The same is true for the pistons 71 to 74 in case of a response of the adding pressure-responsive device 17. With differing cross sectional areas of the pistons 36, 37, 38, 39 and 85, the piston cross sections for the pistons 66 to 69 can be calculated from the ratio $$A_{si} = \frac{p_{sgr} \cdot A_s \cdot A_i}{F_{plgr} \cdot l_p} \cdot y_i, \text{ whereby}$$

$p_{sgr}$ is the turn-off or cut-out pressure in a balance-like adding pressure-responsive device, $A_s$ is the cross sectional area of the counter piston (in this case piston 20), $A_i$ is the cross sectional area of the piston in the pressure space of the "i"-th working stage, $F_{plgr}$ is the limit value of the force in the connecting rod used in the calculation, $l_p$ is the distance of the driving planes from one another, and $y_i$ is the associated distance 41 to 44 respectively 76 to 79.

Figure 2:
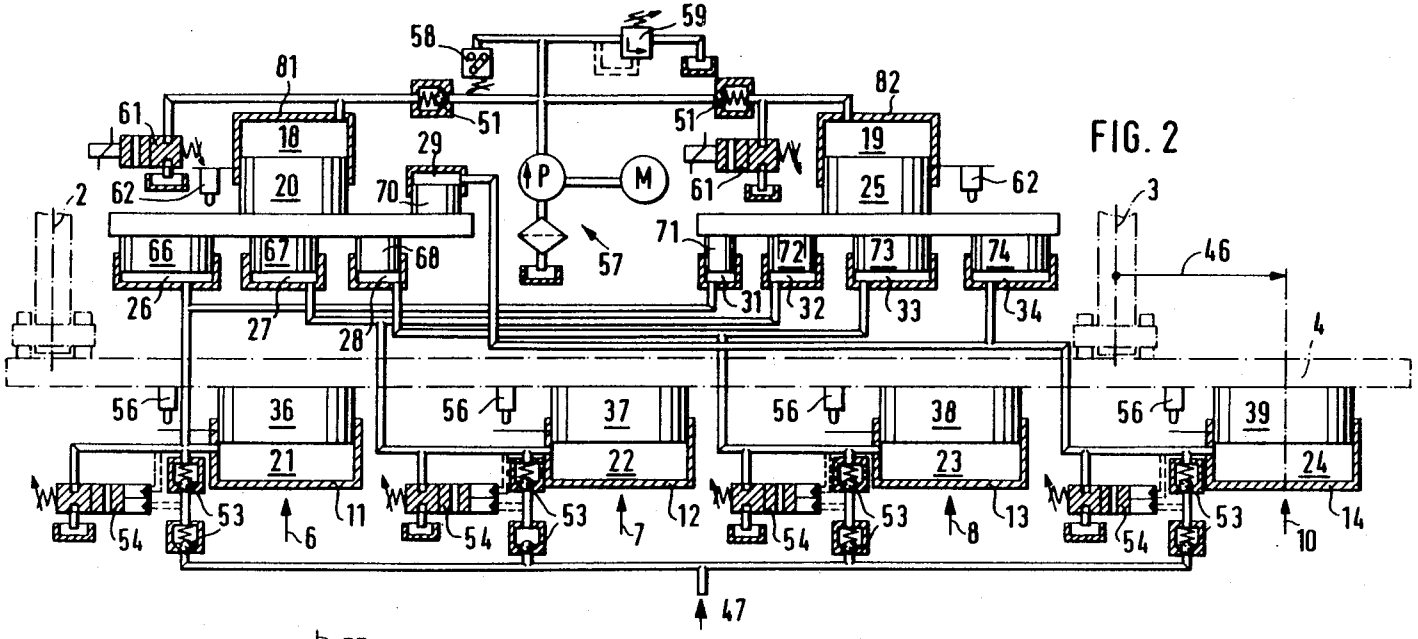
FIG. 2 is a schematic diagrammatic view of a second embodiment of an overload protection according to the present invention with a working stage located outside of an actuating plane.

FIG. 2 illustrates by means of the working stage 10 an area with a balance-like overload pressure-responsive device 14 which is located outside of the actuating plane (in this case actuating plane 3) and which is to be monitored for work tool and press ram protection respectively connecting rod protection; the individual balance-like overload pressure-responsive device 14 is thereby offset to the actuating plane 3 by the distance 46. The pressure space 29 communicating with the pressure space 24 acts with its piston 70 opposite the remaining pressure spaces 26, 27, 28 of this adding pressure-responsive device 81. The pressure space 34, which is also connected in parallel therewith, with the associated piston 74 of the balance-like adding pressure-responsive device 82 acts in the same direction as the further piston and pressure spaces 31, 32, 33 and 71, 72, 73 of this adding pressure-responsive device. The calculation of the cross sectional areas also of the piston 70 of the adding pressure-responsive device 81 can be obtained as described hereinabove. If the distance of the working stages 8 and 10 to the actuating plane 3 is identical with identically large cross sections of the piston 38 and 39, then identical piston cross sections of the pistons 70 and 68 will result. The forces thereof acting on the adding pressure-responsive device 81, however, do not necessarily cancel each other out because the pressures in the working stages need not necessarily be equally large during loading of the press. A force displacing the piston 20 in the pressure space 18 will thus establish itself for the adding device 81, which is reduced by the cross section of the piston 70 multiplied with the pressure in the pressure space 29. The piston cross section calculation of the associated piston 74 of the adding pressure-responsive device 82 is therefore also calculated from the distance 46 of the working stage 10 from the driving plane 2 and the cross section of the piston 39 of the individual overload pressure-responsive device 14.

FIG. 3 illustrates the possibility of a working stage 83 disposed centrally to one of the driving planes, in this embodiment the driving plane 3. The working stages 6 to 10 of the embodiments described hereinabove are connected, for example, by way of the pressure lines 91, 92 and 94 and possibly further pressure lines to the balance-like adding pressure-responsive device 88. The adding pressure-responsive device 88 may also be constructed like the adding pressure-responsive devices 16, respectively 81 of FIGS. 1 and 2 or may replace the same or may replace the adding pressure-responsive devices 17 and 82, and more particularly if the working stage 83 is located centrally to the driving plane 2. The pre-pressure in the overload pressure-responsive device 86 is adjusted by way of the line 87, coming from the pump aggregate 47 as well as the check valves and possibly by pressure limit monitors, as described in connection with the preceding embodiments. This pre-pressure exists at the same time in the line 92 which leads into a partial section 64 closed off by the plunger pistons 66 and 67 or the plunger pistons 67 and 68 from the discharge line 63 leading toward the outside. The partial section 64 is always opened up or released if the overall forces acting on the piston 89 by way of the plunger pistons 66, 67 and 68 are larger than the force resulting from the pressure in the pressure space 90 with the projected area of the piston 89.

The discharge or release of all pressure spaces as well as of the lines connecting the same after a cut-out of the press, of a multi-stage press or a press line, takes place by means of the electrically, pneumatically or advantageously hydraulically actuated valves 54 and 61.

While we have shown and described several embodiments in accordance with the present invention, it is understood that the same is not limited thereto but is susceptible of numerous changes and modifications as known to those skilled in the art and we therefore do not wish to be limited to the details shown and described herein but intend to cover all such changes and modifications as are encompassed by the scope of the appended claims.

We claim:

1. An overload protection for presses, comprising connecting rod means for driving the press in a first actuating plane and in a second actuating plane remote to the first actuating plane, a plurality of working stages, ram means driven by said connecting rod means and acting on said working stages, at least one overload pressure-responsive means coordinated to each working stage, each overload pressure-responsive means having a pressure space means, the overload pressure-responsive means being operatively connected in common to adding pressure-responsive means and the value of the overall overload protection of each adding pressure-responsive means being adjusted smaller than the sum of the values of the individual overload protections of the overload pressure-responsive means, one pressure space means in a first adding pressure-responsive means and one pressure space means in a second adding pressure-responsive means being coordinated to the pressure space means of each overload pressure-responsive means, a piston means for each pressure space means, and the cross section of each piston means acted upon in the first adding pressure-responsive means being proportional to the product of the distance of the connected working stage to the second actuating plane and the piston cross section of the piston means in the corresponding overload pressure-responsive means, and the cross section of each piston means acted upon in a second adding pressure-responsive means being proportional to the product of the distance of the connected working stage to the first actuating plane and the piston cross section of the piston means in the corresponding overload pressure-responsive means.

2. An overload protection according to claim 1, further comprising at least one working stage disposed outside of an actuating plane of the ram means but acted upon by the latter, said last-mentioned working stage including also an overload pressure-responsive means with a pressure space means and a piston means therein, the piston means of the first adding pressure-responsive means which is operatively connected to the overload pressure-responsive means of said last-mentioned working stage and whose piston area calculation is related to the actuating plane which is disposed closest to said last-mentioned working stage, being arranged acting in opposition to the piston means acted upon by the other overload pressure-responsive means connected to said first adding pressure-responsive means.

3. An overload protection according to claim 1, further comprising a working stage disposed substantially centrally to one of the actuating planes and including an overload pressure-responsive means having a pressure space means with a piston means therein, a pressure line leading out of the pressure space means of the overload pressure-responsive means coordinated to said last-mentioned working stage, in addition to being connected with means establishing a pre-pressure in its pressure space means, being additionally connected with a pressure release control means which upon exceeding a limit pressure is operable to release said last-mentioned line and pressure space means of any pressure.

4. An overload protection according to claim 3, further comprising a discharge line for the pressure medium which in case of a cut-out of the press is opened up at the same time as pressure lines by the movement of the piston means of the adding pressure-responsive means, said pressure line leading out of the pressure space means of the overload pressure-responsive means being connected to a partial section of the discharge line operable to be closed off by the piston means.

* * * * *